US007243735B2

(12) United States Patent
Koederitz et al.

(10) Patent No.: US 7,243,735 B2
(45) Date of Patent: Jul. 17, 2007

(54) WELLBORE OPERATIONS MONITORING AND CONTROL SYSTEMS AND METHODS

(75) Inventors: William Leo Koederitz, Cedar Park, TX (US); Terry Lynn Tarvin, Austin, TX (US)

(73) Assignee: Varco I/P, Inc., Houston, TX (US)

( * ) Notice: Subject to any disclaimer, the term of this patent is extended or adjusted under 35 U.S.C. 154(b) by 271 days.

(21) Appl. No.: 11/043,426

(22) Filed: Jan. 26, 2005

(65) Prior Publication Data

US 2006/0162962 A1 Jul. 27, 2006

(51) Int. Cl.
*E21B 47/12* (2006.01)

(52) U.S. Cl. ..... 175/40

(58) Field of Classification Search ..... 175/24–27, 175/38, 40, 48, 50; 702/9
See application file for complete search history.

(56) References Cited

U.S. PATENT DOCUMENTS 4,354,233 A * 10/1982 Zhukovsky et al. ..... 175/27
4,616,321 A 10/1986 Chan et al. ..... 364/422
4,854,397 A 8/1989 Warren et al. ..... 175/26
5,216,917 A * 6/1993 Detournay ..... 175/50
5,465,798 A * 11/1995 Edlund et al. ..... 175/24
6,109,368 A * 8/2000 Goldman et al. ..... 175/40
6,374,926 B1 * 4/2002 Goldman et al. ..... 175/40
6,892,812 B2 * 5/2005 Niedermayr et al. ..... 175/24
2004/0243309 A1 12/2004 Alft et al. ..... 702/9

FOREIGN PATENT DOCUMENTS

GB 2 352 046 A 12/2000

* cited by examiner

*Primary Examiner*—Lanna Mai
*Assistant Examiner*—Matthew J. Smith
(74) *Attorney, Agent, or Firm*—Guy McClung

(57) ABSTRACT

A method for a wellbore operation with a wellbore system, the method, in at least certain aspects, including acquiring with sensor systems data corresponding to a plurality of parameters, the data indicative of values for each parameter, each parameter associated with part of the wellbore system, and, based on said data, calculating a value for each of a plurality of mechanical specific energies each related to a mechanical specific energy for a part of the wellbore system; and, in some aspects, monitoring in real time the value of each of the mechanical specific energies; and, in certain aspects, using such determined values to alter, change, improve, or optimize operations.

28 Claims, 7 Drawing Sheets

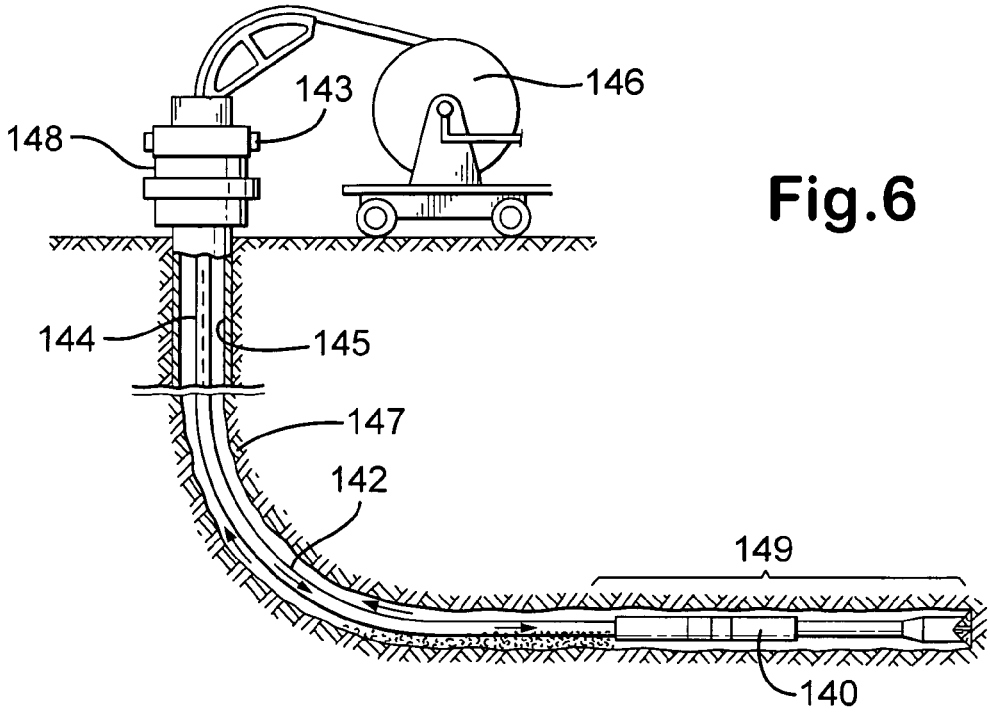
Fig.6
Fig.8A
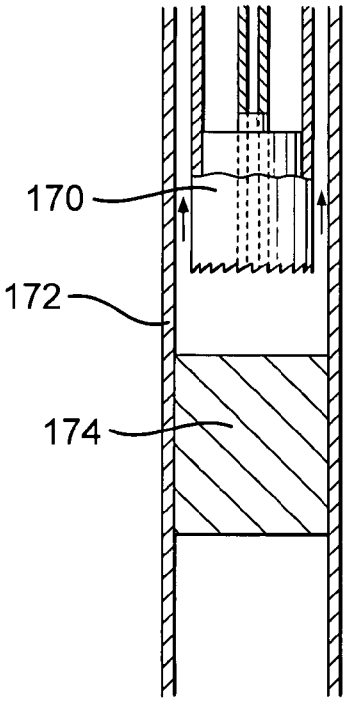
Fig.8B
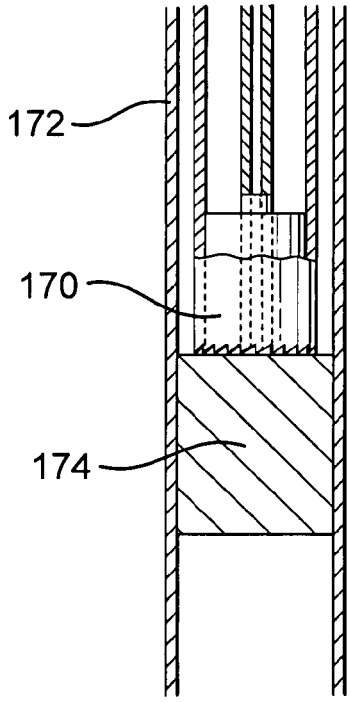

WELLBORE OPERATIONS MONITORING AND CONTROL SYSTEMS AND METHODS

BACKGROUND OF THE INVENTION

1. Field of the Invention

The present invention is directed to monitoring and controlling wellbore operations, and, in one particular aspect, to monitoring and controlling wellbore drilling operations in real time.

2. Description of Related Art

The prior art discloses a wide variety of systems and methods for monitoring wellbore operations and for sensing and measuring parameters related to such operations, both downhole and at the surface. The prior art also discloses a wide variety of sensors, measurement apparatuses, devices, and equipment for sensing, measuring, recording, displaying, calculating, processing, and transmitting measured values for operational parameters, including, but not limited to, weight on bit (WOB), rate of penetration (ROP), rotary speed, bit speed, top drive speed, downhole motor speed, and torque on a drillstring or on a bit.

Many systems and methods have been proposed and implemented for using such sensed and measured operational parameters to enhance, facilitate, and, in some cases, optimize operational performance and the performance of apparatuses, devices and equipment involved in such operations; including, but not limited to, drilling operations. In 1965 R. Teale proposed a model for analyzing and predicting drilling performance based on a calculation of "mechanical specific energy" in an article entitled "The Concept Of Specific Energy In Rock Drilling" [Int'l J. Rock Mech. Mining Sci. (1965) 2, 57-73]. Teale's mathematical definition ("Teale definition") of mechanical specific energy, Es, is:

$$Es = \frac{WOB}{A} + \frac{120\pi(N)(T)}{A(ROP)}$$

In which WOB is weight on bit, N is rpm's of a rig's rotary, T is the torque at the bit, ROP is rate of penetration, and A is wellbore (or bit) cross-sectional area.

In a 1992 research study, (see paper entitled "Quantifying Common Drilling Problems With Mechanical Specific Energy And A Bit-Specific Coefficient of Sliding Friction", SPE 24584, 373-388), R.C. Pessier et al developed an energy balance model for drilling under hydrostatic pressure using a comparison between full-scale simulator tests and field data. As key indices of drilling performance, they employed mechanical efficiency, Teale's mechanical specific energy parameter, and a bit-specific coefficient of sliding friction for bit selection and analysis. "Mechanical specific energy" was defined as work done per unit volume of rock drilled and it was assumed that the minimum specific energy required to drill is approximately equal to the compressive strength of the rock being drilled. The mechanical efficiency of drilling was then estimated by comparing actual specific energy required to drill an interval with the minimum expected specific energy needed to drill that interval. Pessier et al analyzed values of various parameters (actual specific energy, minimum specific energy, energy efficiency, and bit-specific coefficient of sliding friction) with respect to ROP under different situations (e.g., different bits, different WOB's, different RPM's, different hydraulics, and under atmospheric and hydrostatic pressure). It was concluded that mechanical specific energy, mechanical efficiency, and bit-specific coefficient of sliding friction provided good indicators of drilling performance and could enhance the interpretation of data for: the detection and correction of major drilling problems; analysis and optimization of drilling practices; bit selection; failure analysis; evaluation of new drilling technologies and tools; real-time monitoring and controlling of the drilling process; analysis of MWD (measurement while drilling) data; and further system developments.

In a 2002 paper, Waughman et al reported on a system and method for optimizing the bit replacement decision ["Real-Time Specific Energy Monitoring Reveals Drilling Inefficiency and Enhances the Understanding of When to Pull Worn PDC Bits," IADC/SPE 74520, 2002, 1-14]. The system involved measuring the mechanical energy input at the drill rig floor, calculating the drilling specific energy, checking current formation type via real-time downhole gamma ray readings, comparing the specific energy with the benchmark new bit specific energy, and then using these values to assess the bit's "dull" state. Success of the system was reported for synthetic based mud systems Where bit balling does not mask bit dull condition. The process worked in water-based drilling fluids that had replaced earlier synthetic muds because both balled-new bits and dull bits exhibit similar levels of inefficiency.

In general, many prior art systems and methods use undifferentiated mechanical specific energy, i.e., calculations of mechanical specific energy based on sensed and measured values without taking into account the location of the sensors and measurement apparatuses that produce them. No discrimination is made for data obtained from downhole as opposed to surface locations. No differentiation is made between data obtained from locations at the bit as opposed to in the drillstring or at the surface. For example, torque and rotational speed (rpm's) can be measured at various locations—e.g. downhole or at the surface, and the measurement, from whichever location, is then used. The use of such undifferentiated measurements or parameters such as torque, rotational speed, etc. can lead to ambiguous and/or inconsistent determinations of mechanical specific energy.

There is a need, recognized by the present inventors, for efficient and effective systems and methods for monitoring and controlling wellbore operations, and, in one aspect, in which such operations are drilling operations.

There is a need, recognized by the present inventors, for such systems and methods which employ localized and accurate determined values for mechanical specific energy.

SUMMARY OF THE PRESENT INVENTION

The present invention discloses, in certain aspects, methods for wellbore operations with a wellbore system, the methods including: acquiring with sensor systems data corresponding to a plurality of parameters, the data indicative of values for each parameter of the plurality of parameters, each parameter corresponding to part of the wellbore system; based on said data, calculating a mechanical specific energy value for each of a plurality of mechanical specific energies each related to a mechanical specific energy for a part of the wellbore system; and monitoring the value of each of the mechanical specific energies, in one aspect, in real time.

The present invention, in at least certain embodiments, discloses systems and methods for using calculations of mechanical specific energy to enhance, improve, and/or optimize wellbore operations, e.g. drilling, milling, reaming, underreaming, casing drilling, milling-drilling and coiled tubing operations, including: optimizing the bit (or mill) replacement process; analyzing downhole problems related to energy loss; locating a cause of energy loss; eliminating correctly operating systems as a cause of energy loss; and providing real-time confirmation that chosen solutions do not negatively impact components of a drilling system, e.g. bits (or mills), bottomhole assemblies ("BHA"), downhole (mud) motors, and drillstrings. In certain embodiments, the present invention discloses systems and methods for determining localized differentiated mechanical specific energy parameters: surface mechanical specific energy; drillstring mechanical specific energy; and bit (or mill or other apparatus) mechanical specific energy. A variety of equations are available for determining mechanical specific energy, including Teale's definition and the following:

$$MSE = Eff_b \times \left(\frac{4 \times WOB}{\pi \times D^2 \times 1000} \times \frac{480 \times N_b \times T}{D^2 \times ROP \times 1000}\right) \quad \text{[Equation II]}$$

Where:

MSE=Mechanical Specific Energy, Kpsi

Effb=Bit efficiency

WOB=Weight on bit, lbs

D=Bit diameter, inches

Nb=Bit rotational speed, rpm

T=Drillstring rotational torque, ft-lb

ROP=Rate-of-penetration, ft/hr and:

$$MSE = K_{adj} \times Eff_b \times \left(\frac{N_b \times T_{rel}}{D^2 \times ROP}\right) \quad \text{[Equation III]}$$

Where:

MSE=Mechanical Specific Energy $K_{adj}$=Adjustment factor

Effb=Bit efficiency

D=Bit diameter, inches

Nb=Bit rotational speed, rpm $T_{rel}$=Relative measure of drillstring rotational torque, units as per device ROP=Rate-of-penetration, ft/hr The two terms within the parentheses in Equation II are referred to here as "WOB term" (left one with WOB) and "torque term" (right one with T). In general, the magnitude of the torque term is usually much larger than the WOB term.

Surface mechanical specific energy can be calculated using surface inputs, e.g. surface-measured torque, WOB, and/or ROP. Bit mechanical specific energy can be calculated using downhole measured inputs, e.g. downhole measured torque and/or other downhole measured parameters or, in one aspect, using surface measured inputs, e.g. WOB, ROP, bit RPM (surface measured); i.e., where downhole measured values are not available and/or where they do not impact calculated mechanical specific energy values. "Downhole measured" means "actually measured" downhole (e.g. measured torque of a downhole motor) or it means derived from other downhole measured values (e.g. torque derived from mud motor parameters) and/or may mean "derived from" surface measured data, e.g. torque as determined with measurements from a measured pressure differential across a downhole motor.

Bit mechanical specific energy is calculated using available downhole data and, in certain aspects, is the same as downhole mechanical specific energy. In one aspect, bit mechanical specific energy uses a minimum of required downhole inputs, e.g. enough key values to quantify the mechanical specific energy, e.g. only downhole measured torque, only downhole measured WOB or only downhole measured bit RPM.

In certain aspects, the use of localized differentiated mechanical specific energy values: enhances the diagnostic potential and efficiency of the diagnosis of bit vs. drillstring mechanics; indicates more clearly than certain prior art systems the sources of data, i.e. where energy loss is occurring, e.g. loss occurring at the bit, (or mill or other apparatus) between the bit and the surface, or at any point, in a drillstring or for any tool or apparatus in a drillstring or other string; provides more understandable interpretation and presentation of data on site at a rig; and provides for the use of data from both downhole and from the surface to generate more accurate calculations.

In one embodiment a determination of drillstring (or other string) mechanical specific energy is made by calculating the difference between surface mechanical specific energy and bit mechanical specific energy.

In addition to specific objects stated herein for at least certain preferred embodiments of the invention (but not necessarily for all embodiments of the present invention), other objects and purposes will be readily apparent to one of skill in this art who has the benefit of this invention's teachings and disclosures. It is, therefore, an object of at least certain preferred embodiments of the present invention to provide new, unique, useful, and nonobvious systems and methods of their use—all of which are not anticipated by, rendered obvious by, suggested by, or even implied by any of the prior art, either alone or in any possible legal combination.

Certain embodiments of this invention are not limited to any particular individual feature disclosed here, but include combinations of them distinguished from the prior art in their structures and functions. Additional aspects of the invention are described below and may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods.

The present invention recognizes and addresses the previously-mentioned problems and long-felt needs and provides a solution to those problems and a satisfactory meeting of those needs. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

The Abstract that is part hereof is to enable the United States Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

DESCRIPTION OF THE DRAWINGS

A more particular description of embodiments of the invention briefly summarized above may be had by references to the embodiments that are shown in the drawings which form a part of this specification. These drawings illustrate certain preferred embodiments and are not to be used to improperly limit the scope of the invention that may have other equally effective or legally equivalent embodiments.

FIG. 6 is a schematic view of a coiled tubing drilling operation according to the present invention.

FIG. 8A is a side schematic view of a step in a wellbore milling operation according to the present invention.

FIG. 8B is a step in the operation of FIG. 8A subsequent to the step shown in FIG. 8A.

DESCRIPTION OF EMBODIMENTS PREFERRED AT THE TIME OF FILING FOR THIS PATENT

Figure 1A:
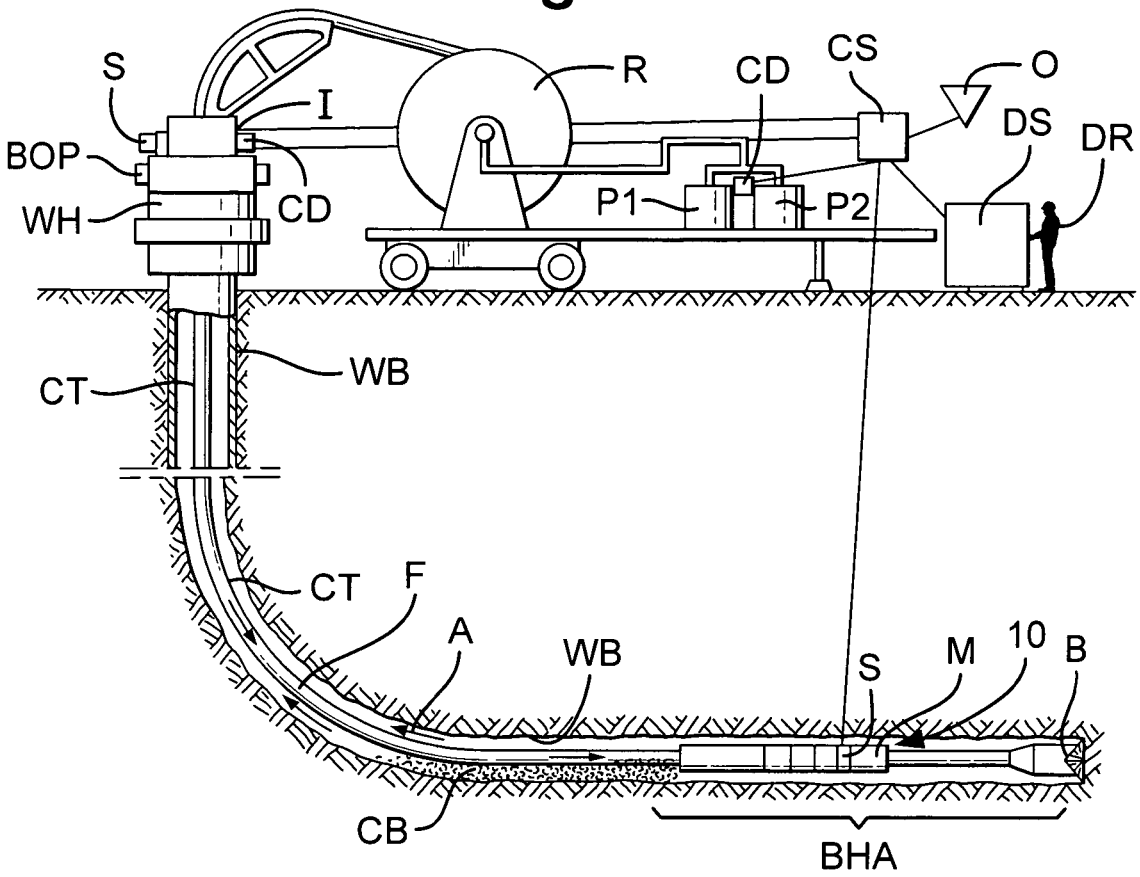
FIG. 1A is a schematic view of a wellbore operation system according to the present invention.

In one particular embodiment of a system and method according to the present invention, as shown in FIG. 1A, a downhole motor drilling system 10 is used to drill a wellbore WB. The system 10 has a bottom hole assembly BHA with a bit B and a mud motor M which is connected to coiled tubing CT from a reel R which extends through an injector I into and through a BOP and a wellhead WH. Fluid F is pumped down to the BHA by pumps P1, P2. Cuttings CB flow up an annulus A with fluid F pumped out of the bit B. Sensors S provide signals indicative of various parameters, including, e.g., WOB, ROP, torque, bit rotation speed, and bit cross-section area. WOB, ROP, and/or torque can be measured by sensor(s) S at the injector I and/or downhole. Bit rotational speed (zero at the surface, by definition) is measured downhole. The sensors are in communication with a system CS (e.g. a computer system or systems, PLC's, and/or DSP's). The system CS calculates differentiated mechanical specific energies; e.g. three different mechanical specific energies—drillstring, bit, and surface. Any suitable known downhole sensors can be used (for the system and method of FIG. 1A and/or for any system and method disclosed herein), including, but not limited to, those disclosed in U.S. Pat. Nos. 6,839,000; 6,564,883; 6,429,784; 6,247,542; and in the references cited therein, all incorporated fully herein for all purposes.

In one scenario a driller DR views a display (screen and/or strip chart) DS which indicates in real time the value of and change (if any) in drillstring mechanical specific energy, bit mechanical specific energy, and surface mechanical specific energy. The system may provide and the display may also display results post-event, not in real time. In one aspect the system CS is programmed to produce an alarm (audio and/or visual) when a certain level of mechanical specific energy is approached or exceeded. In a particular scenario, bit mechanical specific energy is acceptable, but severe drillstring vibrations are causing high energy losses in the BHA and in the drillstring. The driller DR in viewing the display DS (e.g. as in FIG. 1B) hears/sees an alarm and sees that bit mechanical specific energy is acceptable but that drillstring mechanical specific energy (and/or also surface mechanical specific energy) has exceeded a pre-set limit. The development of the problem in the drillstring and its location (at any point in the drillstring, in the BHA, at any interval in the drillstring for which sensed data is available such than an effective mechanical specific energy value can be determined) is seen from the display. If drillstring mechanical specific energy and surface mechanical specific energy have exceeded pre-set limits, the driller knows the problem is localized/isolated in the drillstring and is not at the surface (e.g. he knows the problem is at the bit or between the bit and the surface). Since bit mechanical specific energy is and has remained acceptable, it is clear that there is no problem in the bit and bit repair or replacement is ignored as an option for solving the problem. After attempting a solution of the problem [e.g. altering the rotational speed of the drillstring (of the bit) or altering WOB], the driller DR continues to monitor the display DS to insure that the attempted solution has not negatively impacted bit operation (i.e., he monitors the display to see if bit mechanical specific energy remains at an acceptable level).

Figure 1B:
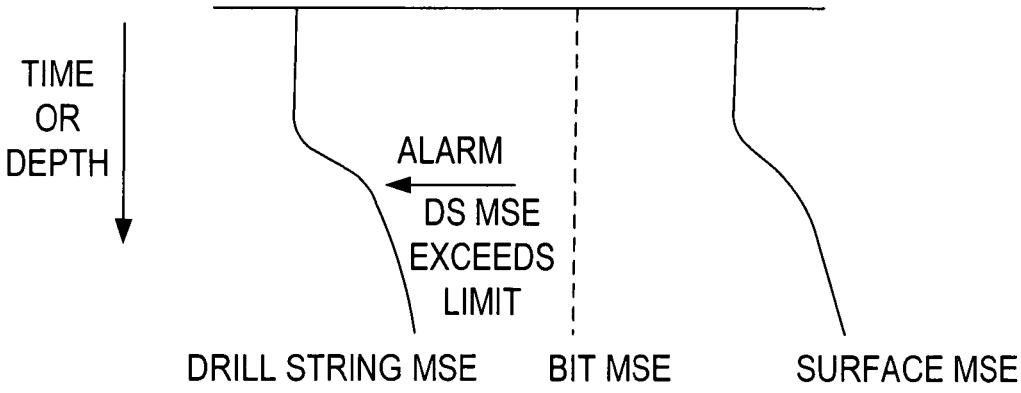
FIG. 1B is a view of a driller's screen display for the system of FIG. 1A.
Figure 1C:
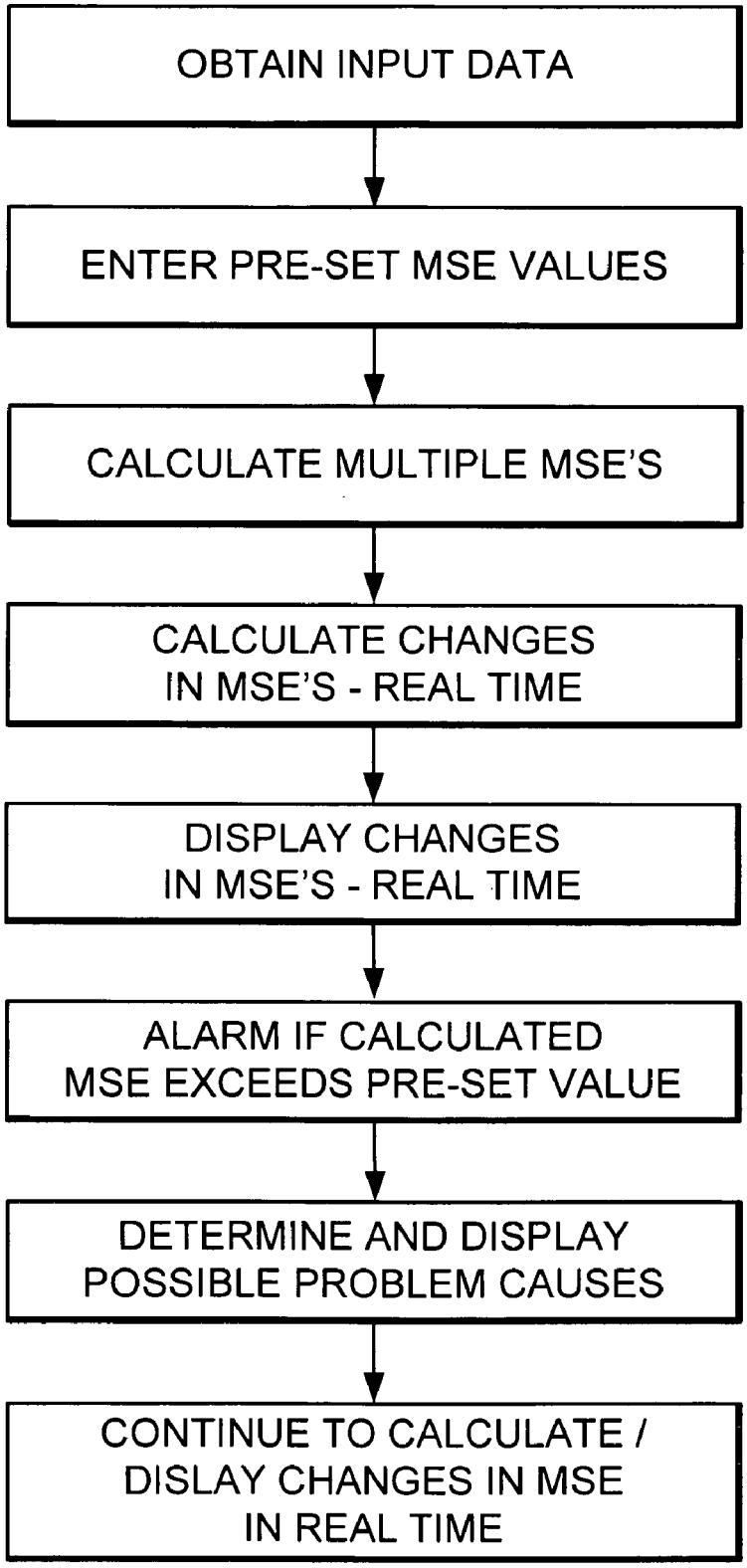
FIG. 1C is a diagram of a program for the control system of the system of FIG. 1A.

FIG. 1C illustrates schematically an operation of the system of FIG. 1A and programming for the control system 50. Without the present invention's provision of a system utilizing the three differentiated mechanical specific energy values, a driller DR in the scenario described above may or may not suspect a drillstring energy loss is occurring, as opposed to a problem at the bit or at the surface. If the driller does suspect that there is only a drillstring problem, he would look at individual pieces of data, e.g. he could compare surface torque and downhole torque (e.g. derived from a pressure differential across the mud motor). Finally, he infers further that addressing the drillstring energy loss is required to solve the problem. The systems and methods according to the present invention take the guesswork and inference out of the solution process and provide an accurate isolation of a problem's cause and an indication of probable solutions.

The system as shown, e.g., in FIGS. 1A and 1B can also be used to control various aspects of a wellbore operation. For example, in one specific embodiment, the system CS (e.g. any suitable computer, computer system, or programmable system) is programmed to monitor mechanical specific energy in real time and to take certain actions if a pre-set level for any mechanical specific energy value is exceeded [and to take action if a mechanical specific energy value goes up dramatically or "spikes", yet does not exceed pre-set value or goes down, which might indicate a change in the formation being drilled if controllable drilling parameters (e.g. WOB, RPM) were not changed]. The system CS is programmed to control any drilling parameter or set of parameters (e.g. one or some in any combination, of WOB, ROP, torque and/or bit speed). The computer CS is programmed to perform one, some, or all of the following actions:

- provide warnings to the driller DR and to others on site and/or remote from the rig, e.g. in a remote facility O (by any known type of communication) e.g. warnings of increased energy consumption per volume drilled which can lead to a determination of bit failure, bit tooth breakage, bearing failure, bottom hole balling, drillstring vibration, bit whirl, and bit vibration
- execute control with controls CD of appropriate equipment and apparatuses to maintain mechanical specific energies at or below target or not-to-exceed values [e.g. control devices CD for controlling the injector I (e.g. pipe feed rate, thereby controlling WOB; and controls CD on the pumps P1, P2 to control fluid flow, thereby controlling mud motor RPM)]
- conduct diagnostic tests of apparatuses and equipment (and of the wellbore itself) to locate source of a problem and, in one aspect, to choose and/or display possible courses of corrective action.
- execute control to effect a higher-level strategy, e.g., simultaneously optimizing ROP and mechanical specific energy to optimize drilling performance
- (optionally) execute control to effect a higher-level strategy, e.g., simultaneously minimizing ROP and mechanical specific energy to optimize drilling
- instruct driller, e.g., "contact company man to consider bit change;" "trip for new bit;" or "conduct diagnostic test"

Figure 2:
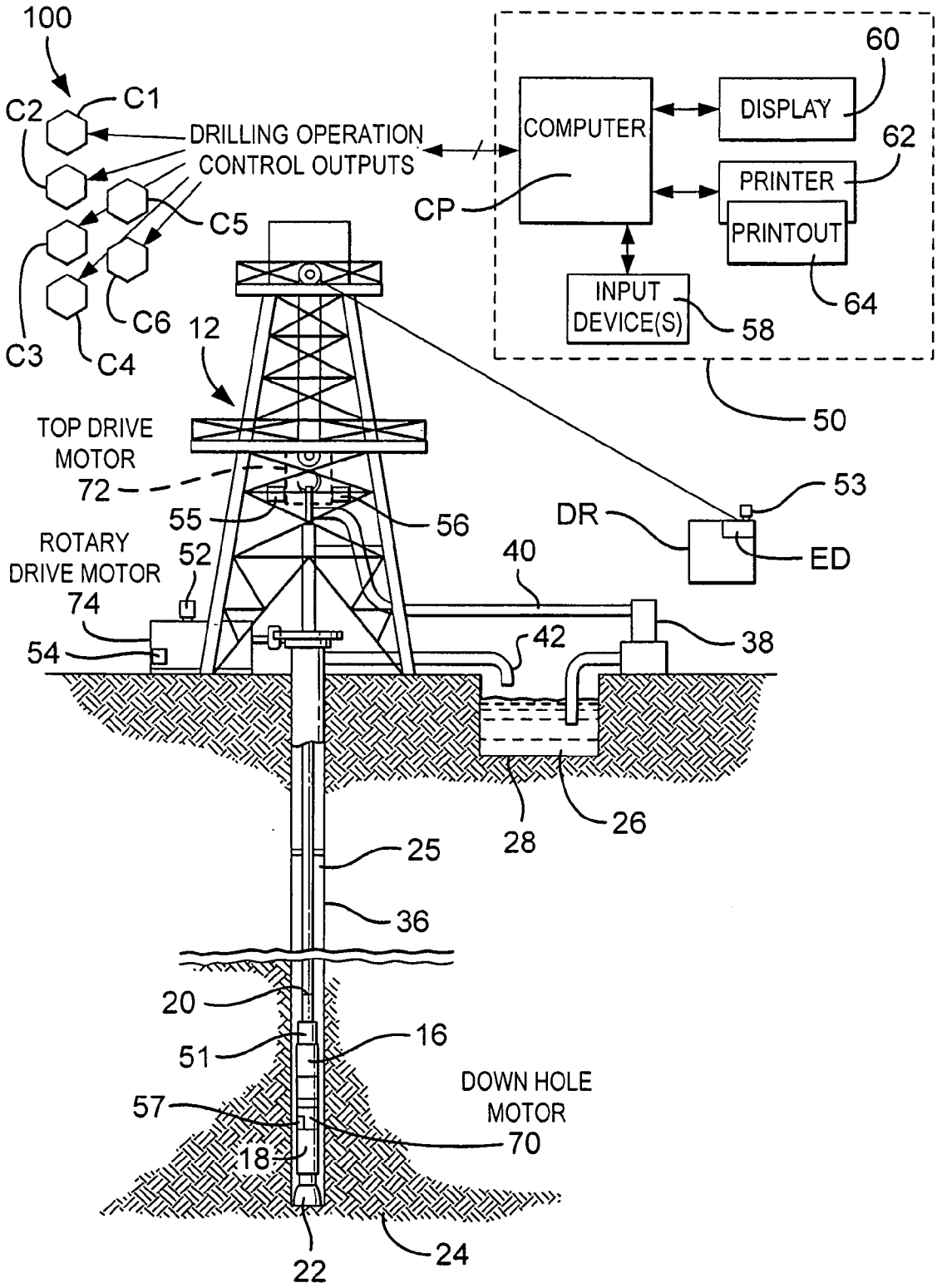
FIG. 2 is a schematic view of a wellbore operation system according to the present invention.

FIG. 2 illustrates one system 100 and method according to the present invention which has sensors 51-57 for providing data for calculating WOB, ROP, bit speed and torque. As shown, FIG. 2 has a top drive 72, a rotary drive 74 and a downhole motor 70 to indicate that any of these drive systems may be used with systems and methods according to the present invention.

A drillstring 20 extending down from a rig 12 into a wellbore 36 in an earth formation 24 has a bit 22 on a bottom hole assembly 16 at the wellbore bottom. Drilling fluid 26 flows from a tank or pit 28 pumped by a pump system 38 through a piping system 40 down the drillstring 20 and returning up an annulus 25 flowing in a line 42 back to the tank 28.

A control system 50 includes a computer CP with a display 60, a printer 62 and a printout 64. Input devices 58 receive data signals from the sensors 51-57 which are in communication with the computer via wire, cable and/or wireless communication. For example, sensors may provide signals indicative of the following: WOB, at the surface from a sensor or a drill line anchor or downhole from a sensor 51 of an MWD unit; torque, at the surface from a sensor 52 of the rotary drive 74 or from a sensor 55 of the top drive 72, or downhole from the sensor 51; ROP, at the surface from a sensor 53 on an encoder ED of a drawworks DR (shown schematically) or from the sensor 51; and bit rotational speed at the surface from a sensor 55 in the top drive or from a sensor 54 in the rotary drive or downhole from the sensor 51; or from a sensor 57 in the motor 70. The computer CP calculates three differentiated mechanical specific energies, drillstring mechanical specific energy, bit mechanical specific energy, and surface mechanical specific energy, and then decides whether to provide alarms and/or to execute control programs to control various aspects of the drilling process.

The drilling operation control outputs from the computer CP are provided to various controllers and control systems C1-C6 which control drill line payout (brake control and/or drawworks motors control); a rotary table (control bit speed); a top drive (control bit speed) mud pumps (pump rate control) downhole drilling systems, and/or rotary steerable systems. In one particular method of use of the system 100, a new bit 22 is tripped into the wellbore and the drillstring 20 is run down to the wellbore bottom. The driller enters into the computer CP target ROP, bit rotational speed, drilling fluid pump rate, and WOB. The control system 50 then prepares to collect data related to all the drilling parameters to be measured and monitored and calculates and displays the three mechanical specific energies. The system 50 proceeds to determine a background mechanical specific energy level with drilling at "safest" conditions and determines that the entire allowable operating range for WOB, RPM, torque and ROP is within safe limits. In one aspect WOB and bit RPM are directly controlled by the driller. Torque and ROP are resultants of this control, but can also be controlled, for example, by adjusting WOB and/or rotational speed to alter the resultant torque and ROP's. The driller then starts drilling with the target ROP, WOB, RPM, and pump rate. The system 50 informs the driller that the drilling process in progress is acceptable. In one particular scenario, the system 50 then detects an increase in bit mechanical specific energy, informs the driller that an abnormal event is occurring, and begins a diagnostic process. The system 50 moves all control parameters to a safe (or safest) value (e.g. to values at which bit balling will not occur), e.g. minimum WOB, maximum RPM, and maximum drilling fluid pump rate. The system 50 controls equipment directly or sends set points to individual devices' controllers. In this case, the bit mechanical specific energy then returns to an acceptable or baseline value and the system 50 concludes that bit balling had been occurring when the drilling operation was at the original target values the driller had been using. The system 50 then informs personnel, e.g. the driller and/or the company man, that bit balling has been detected and the system 50 offers two possible course of action: 1. replace the bit; 2. let the system 50 attempt to find a maximum ROP at which balling will not occur. In the event option 2. is chosen, the rig personnel can decide if the calculated ROP is acceptable for further drilling. In the event option 2. is chosen, the control system resumes drilling at the determined safe values of the drilling parameters (e.g. those at which bit balling is least likely to occur) and then manipulates ROP, RPM, WOB and pump rate to achieve maximum ROP while seeing that bit mechanical specific energy is maintained at or below "no balling" values.

Figure 3:
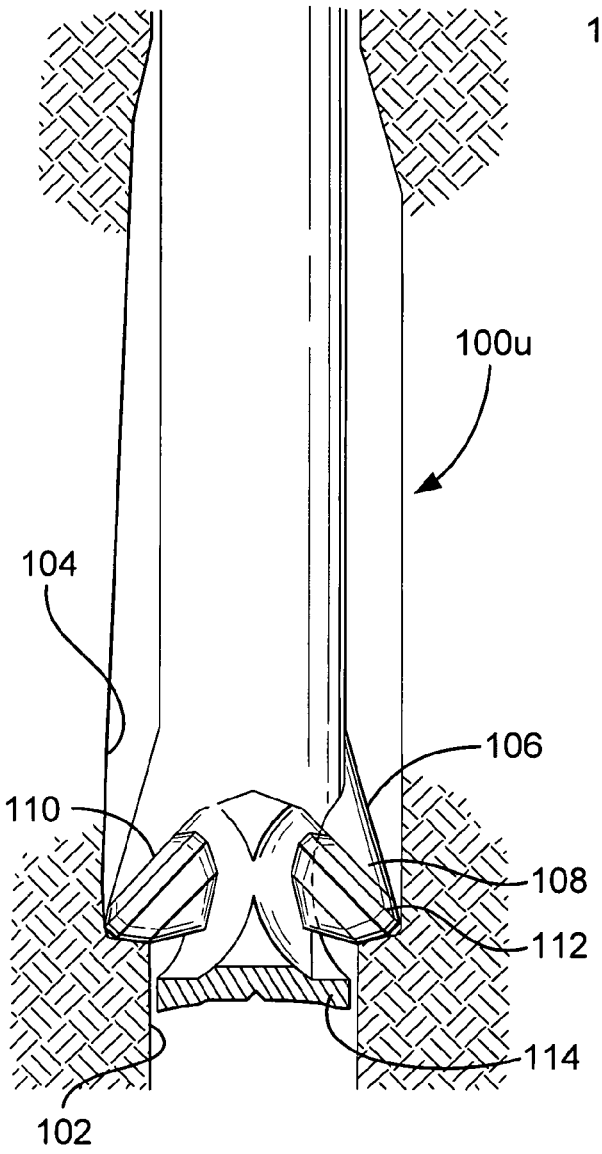
FIG. 3 is a side cross-section view of a wellbore hole-opening operation according to the present invention.

FIG. 3 illustrates a wellbore hole-opening operation 100*u* (or "underreaming") in which the diameter of an already-drilled hole 102 is increased to a hole 104 with a wider diameter with an assembly 106 including an under-reamer 108 which has expandable arms 110, with cutters 112 on the end, and a drill bit 114. The drill bit 114 can remove fill or cave-in material and/or can ream the hole back to gauge. In hole-opening methods according to the present invention, mechanical specific energies are calculated using a volume of material, e.g. rock or formation of the outer ring of the hole 104 that is drilled out (i.e. between the original hole size of the hole 102 and the new hole size of the hole 104). The mechanical specific energy calculations are modified as follows to account for this difference (to account for the area actually drilled):

$$Es = \frac{WOB}{A_{104} - A_{102}} + \frac{120\pi(N)(T)}{(A_{104} - A_{102})(ROP)} \quad \text{[Equation IV]}$$

Where $A_{104}$ is the area of the new hole 104 and $A_{102}$ is the area of the original hole 102. The values for mechanical specific energies determined in drilling the original hole are used for comparison during the hole-opening. Abnormally high values may indicate that the underreamer 108 (and possibly the drill bit 104) is drilling a larger-than-expected area of rock (for example, hole totally caved in) or that the under-reamer has mechanical problems, worn bit, etc.

In methods according to the present invention in which a hole opener with cutters is run with a bit and both drill simultaneously (e.g. if no hole was previously drilled), the effective "bit diameter" for mechanical specific energy calculations is the diameter of the hole opener's cutters. Alternatively according to the present invention an underreamer can be run in a hole separate from or without a bit.

Figure 4:
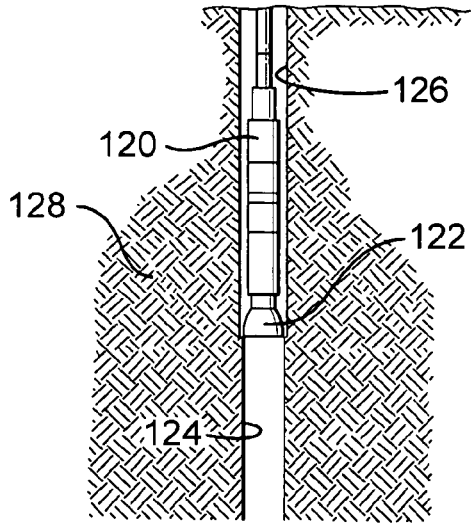
FIG. 4 is a side cross-section view of a wellbore reaming operation according to the present invention.

Reaming is a method of "drilling again" an already-drilled hole section; e.g., as shown in FIG. 4, a drilling system 120 with a bit 122 is reaming a hole 124 in a formation 128 to a reamed hole diameter of a new hole 126. Often, this is pumping and rotating the drill string down through a section to insure that the hole has stayed the desired gauge (i.e. drilled) size. This is often a common practice, where each new section (stand or joint) is reamed before stopping to make a connection. In one case an under-gauge hole is reamed (for example, a previously used bit had gage wear around the outside and did not drill a full size hole), where reaming drills out the outer diameter that was missed the first time. Reaming is normally a low-energy process, since minimal rock is removed. However, some situations, such as drilling an under-gauge hole, can be challenging, due to drill bits being designed for drilling out a full-cross-section of rock, as opposed to drilling only the outer ring and encountering high side forces from the sloped sides of the hole. In a reaming method according to the present invention, mechanical specific energies are computed by the same methods used for drilling as described above (i.e. as if a new hole were being drilled) and the calculated values for reaming to the new hole 126 are compared to those obtained (and stored in memory of a system, as can be done with any system according to the present invention with any measurements, inputs, and/or calculated mechanical specific energies) during the original drilling procedure for drilling the hole 124. The values for reaming should be considerably lower than those of the original drilling, due to the minimal rock being removed. If they are high, then some downhole problem, such as pinching in under-gauge hole, may be indicated. These high values may indicate a problem with the drilling process (during reaming), or they may indicate a problem resulting from the original drilling process (such as the presence of under-gauge hole).

Figure 5:
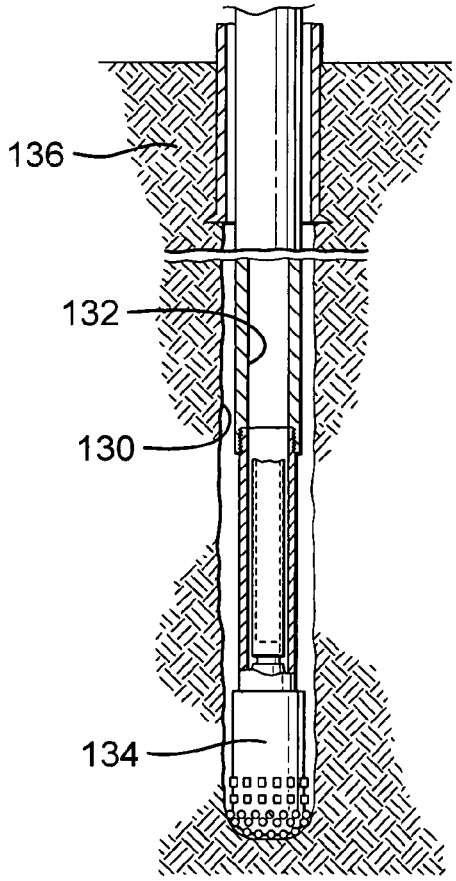
FIG. 5 is a side cross-section view of a wellbore casing drilling operation according to the present invention.
Figure 7D:
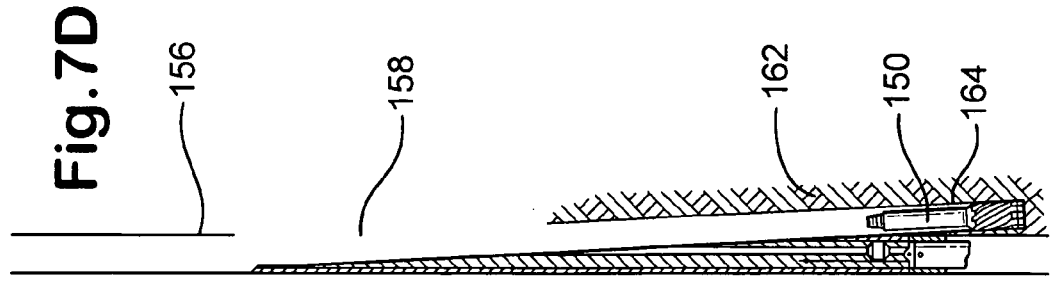
FIG. 7D is a step in the operation of FIG. 7A subsequent to the step shown in FIG. 7C.
Figure 7C:
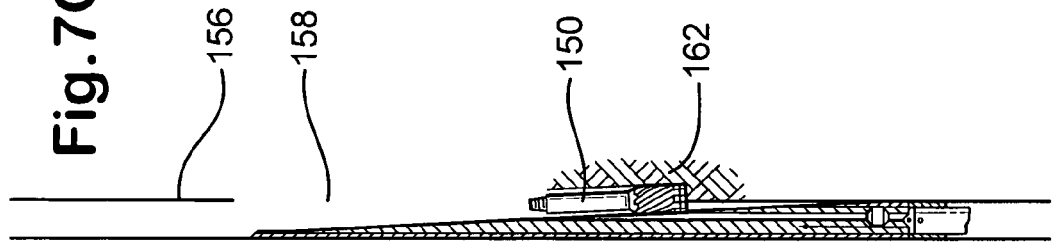
FIG. 7C is a step in the operation of FIG. 7A subsequent to the step shown in FIG. 7B.
Figure 7B:
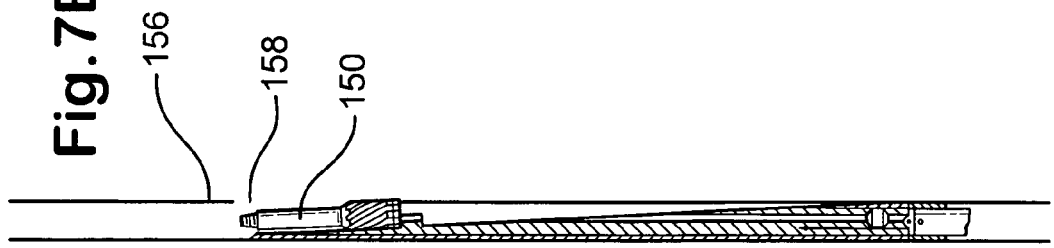
FIG. 7B is a step in the operation of FIG. 7A subsequent to the step shown in FIG. 7A.
Figure 7A:
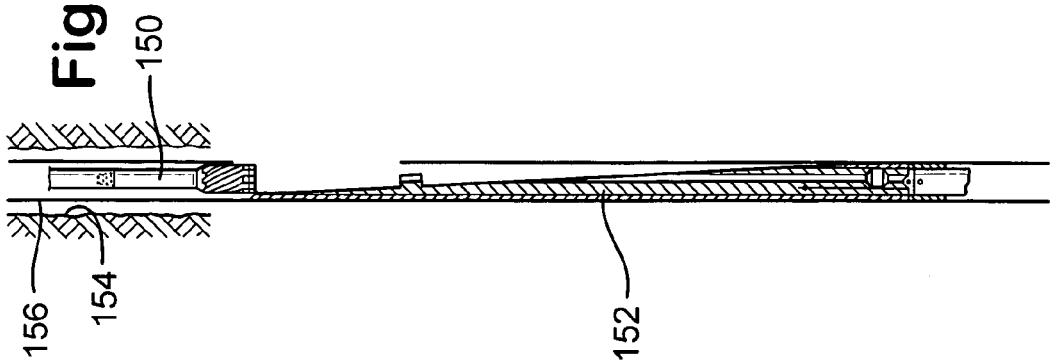
FIG. 7A is a side schematic view of a step in a wellbore milling operation according to the present invention.

Casing drilling, see e.g. FIG. 5, is a process whereby a hole 130 is drilled using the casing which will be cemented into the drilled hole 130 in a formation 136 without using a drillstring to drill (in one aspect without any additional trips for casing the hole). A bit 134 (or other hole maker) used to make the hole may be wireline retrievable inside the casing 132, or it may be a disposable and/or drillable bit or hole maker attached to the end of the casing 132. In casing drilling methods according to the present invention, mechanical specific energies are calculated in principle as described above for drilling. Methods using mechanical specific energies calculated according to the present invention for casing drilling procedures are useful as follows:

- Wireline bits may have a relatively shorter life and/or less "design strength" than full-size conventional drill bits. Methods according to the present invention for calculating mechanical specific energies for this situation can provide early warning when such bits are severely worn or near failure.
- Disposable bits or hole makers can exhibit poor performance or failure to drill if they wear out prematurely. If this happens, a likely recourse would be to either drill out the disposable bit or hole maker and continue with a wireline one, or trip the casing for a new bit or hole maker. Methods according to the present invention are useful in maximizing bit life and/or in detecting failure or diminished performance.
- There can be less tolerance between casing and hole than there is between drillpipe and hole. This can cause excessive drag and wear on the casing body and on the connections. Methods according to the present invention for calculating mechanical specific energies in this situation may identify such problem situations at an early stage, and/or can be useful as a monitor to see if corrective actions have mitigated a problem.

Systems and methods according to the present invention may be used with casing drilling systems and methods disclosed in U.S. Pat. Nos. 5,197,553; 5,271,472; 5,472,057; 6,443,247; 6,640,903; 6,705,413; 6,722,451; 6,725,919; 6,739,392; 6,758,278; and in references cited in these patents—all incorporated fully herein for all purposes.

In certain coiled tubing drilling operations using methods according to the present invention, see, e.g. FIG. 6, drilling is done with a mud motor 140 on the end of coiled tubing 142. Downhole data is obtained via MWD ("measurement-while-drilling") pulsing or a cable 144 run inside the coiled tubing 142 (providing higher resolution data). The coiled tubing 142 is provided from a reel system 146 through a BOP 143 and a wellhead 148 into a wellbore 145 in an earth formation 147. The mud motor 140 is part of a typical downhole bottom hole assembly 149. Compared to conventional drilling with drillpipe, coiled tubing drilling can provide faster tripping speed, no connections (hence no stopping pump and circulation, and better downhole pressure control) and an option for higher resolution downhole data. Coiled tubing can have lower strength of the tubing (especially in torsion), less weight available to put on bit, smaller pipe internal diameter (limiting flow rates and hydraulics), no option to rotate pipe from surface, and smaller bit sizes. Coiled tubing drilling is often used for niche applications, such as re-drilling a producing zone for less damage or for staying within a thin formation interval. In certain coiled tubing methods according to the present invention mechanical specific energies are calculated as described above for drilling. Such methods may provide the following additional benefits:

- Due to the limitations such as poor hydraulics, low pipe torsional strength and low bit weight, such methods according to the present invention can provide an additional tool for improved selection of a bit (or other apparatus) and of a drilling assembly.
- Since tripping is fast and relatively easy in coiled tubing operations, such methods according to the present invention can contribute to improved decisions on when to change a bit (or other apparatus) versus when to continue.
- Maximum performance of equipment in the hole can be achieved by running such that mechanical specific energies as calculated according to the present invention are at target values.

Milling is the process of milling away an object in a wellbore or milling out a section of a casing (or tubular) wall and can include drilling a formation, e.g. drilling enough of an adjacent formation so that a conventional drilling assembly can be used to continue drilling into the formation. FIGS. 7A-7D illustrate a milling process using methods according to the present invention. A mill 150 either releasably attached to or separate from a whipstock 152 (or other mill diverter, mill guide, or turner) is lowered into a wellbore 154 which is cased with casing 156. The mill 150 mills a hole or "window" 158 in the casing 156. As the mill 150 mills through the casing 156 (see FIG. 7B) it begins to cut away earth from an earth formation 162 adjacent the casing 156. If it is allowed to proceed (see FIG. 7D) the mill 150 mills a hole 164 in the earth formation 162. The methods of the present invention are useful in milling procedures and in milling/drilling or milling-and-drill procedures, e.g., in the system and methods of U.S. Pat. Nos. 5,474,126; 5,522,461; 5,531,271; 5,544,704; 5,551,509; 5,584,350; 5,620,051; 5,657,820; 5,725,060; 5,727,629; 5,735,350; 5,887,655; 5,887,668; 6,202,752; 6,612,383; and in the references cited in these patents—all of which are incorporated fully herein for all purposes. In a milling process, from start to finish, a mill often does not drill a homogenous material, but rather a continually-changing mixture of mud (i.e. open space), steel, cement and/or formation. A variety of feedback items are of value during milling; e.g. indications that the process is progressing as desired; an indication that the casing (or tubular) wall is first penetrated; and an indication that the mill has fully exited the casing (or tubular) and is totally into the formation. In milling methods according to the present invention mechanical specific energies are calculated in a manner similar to that for drilling as described above. The bit diameter used is the mill diameter. Calculated mechanical specific energies indicate the rate of energy used per rate of milling. Since a mill may encounter many conditions (which are unknown at the surface), patterns (or signatures) developed for particular mills and/or particular milling methods, mill behavior, and/or key events can, according to the present invention, be developed over time and stored in a retrievable, searchable database or memory which can be queried and used in a present-time particular situation. Methods according to the present invention using mechanical specific energies calculated according to the present invention can indicate:

- Change in mechanical specific energy as casing (or other tubular or other item to be milled) is first encountered.
- Trend and/or change in mechanical specific energy behavior as increasing (i.e. cross-sectional area as seen by mill) amounts of casing (or other tubular or other item) are milled.
- Drop in mechanical specific energy as a mill exits casing (or tubular).
- Return of mechanical specific energy to that representative of drilling as mill fully encounters formation adjacent the casing (or other tubular). Since a bit is more efficient at drilling a formation than a mill, the mill mechanical specific energy may be different, but it will be identifiable as being fully into the formation.

Milling up undesirable material from a wellbore is often done after other extraction methods have been exhausted. "Junk" in drilling operations can include items dropped in the hole, e.g. hand tools, and rock bit cones that have fallen off a drill bit. Examples of junk in workover operations are packers and bridge plugs. FIGS. 8A and 8B show a mill 170 in casing 172 in a wellbore (not shown) milling a piece of junk 174 (shown schematically). Alternatively, the junk 174 may be a packer or other item that is to be milled out. Often in such milling methods, from start to finish, the mill does not drill a homogenous material, but rather an unknown (at the surface) mixture of components (metal, plastic, etc.), cuttings and/or possibly formation fill, such as sand. Some additional feedback items that are provided during milling methods according to the present invention using mechanical specific energies calculated according to the present invention during such milling methods are indications that the process is progressing as desired and whether the mill is milling part of the junk or is milling something else, e.g. casing, which is undesirable. The mechanical specific energies for such methods are calculated in a manner similar to that for drilling as described above. The mill diameter is the bit diameter. Calculated mechanical specific energies in these milling situations measure the rate of energy used per rate of milling. Since a mill can encounter many conditions (which are unknown at the surface), patterns (or signatures) of mill behavior and of key events are developed over time and stored in a searchable, retrievable database. Some examples of these are:

- Change in mechanical specific energy as junk (or a packer) is first encountered.
- Trend of mechanical specific energy behavior as the junk (or packer) is progressively milled up.
- Change in mechanical specific energy as a mill encounters various components or segments of the junk or of a packer or other item.
- Change in mechanical specific energy if a mill encounters unanticipated or undesirable components, such as cutting into a casing wall.
- Return of mechanical specific energy values to those representative of drilling if mill fully encounters formation. Since a bit is more efficient at drilling formation than a mill, the mill mechanical specific energy value may be different, but is still identifiable as being into or fully into the formation.

Figure 9:
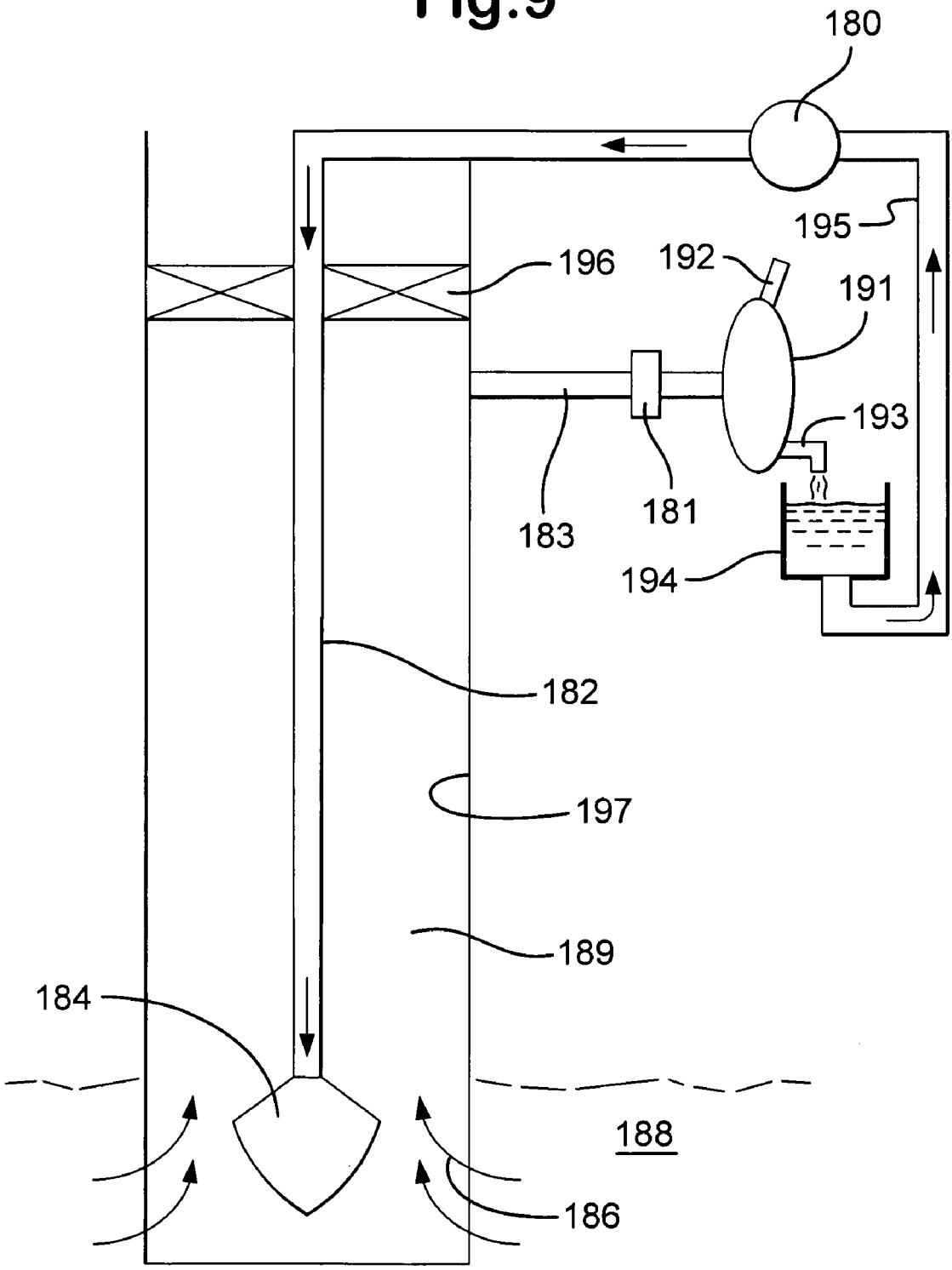
FIG. 9 is a schematic view of an underbalanced drilling operation according to the present invention.

Managed pressure drilling (MPD) includes drilling with downhole pressure control provided by dynamic control of the annulus pressure in a wellbore. Underbalanced drilling (UBD) is a subset of managed pressure drilling whereby the downhole pressure is managed so that it is below the formation pressure of a formation through which the wellbore extends and formation fluids are allowed to flow to the surface. FIG. 9 illustrates use of methods according to the present invention in an underbalanced drilling operation. Mud pumps 180 provide drilling fluid under pressure down a drillstring 182 to a drill bit 184 at a pressure sufficiently low so that formation fluids 186 can flow from a formation 188 into an annulus 189 around the bit 184 and drillstring 182 up to an exit line 183. A choke system 181 controls flow to a tank or reservoir 191 which has an upper flare 192 for flaring gas and a lower line 193 through which fluid flows to a mud pit 194 which is in fluid communication via a line 195 with the mud pumps 180. Optionally a BOP 196 is used on the wellbore 197. Methods for MPD and UBD according to the present invention use mechanical specific energy values calculated in a manner similar to that for drilling as described above. Such methods according to the present invention may provide the following additional benefits:

In MPD and UBD methods according to the present invention, mechanical specific energy values may be impacted by a pressure differential at the hole bottom; i.e. between a wellbore pressure below the bit and a pore pressure in the formation being drilled. Detected changes in mechanical specific energy in known areas such as these can provide feedback on the magnitude of this differential.

Adjusting annulus pressure and looking for response in calculated mechanical specific energy values provides another technique to quantify this pressure differential, and/or to verify that it meets target requirements.

Mechanical specific energy values determined by methods according to the present invention for UBD wells and for MPD wells (where wellbore pressure is below that used for conventionally-drilled wells) can show a characteristically lower mechanical specific energy value, as less energy may be required to drill.

Confirmation that drilling is progressing normally.

In some circumstances Equation II (see above) or Teale's definition are not used for calculating mechanical specific energy; e.g. there are many rigs where the drillstring rotational torque is not available in ft-lbs. An example of this is the commercially available M/D Totco Rotary Torque System, an hydraulic system for mechanical rigs. This system measures deflection in the chain driving the rotary table and outputs this deflection as an hydraulic pressure in psi. If the torque is not available in ft-lbs, then a value of mechanical specific energy in Kpsi cannot be computed. However, being able to compute an equivalent value that is proportional to what would be the value of mechanical specific energy still has value in a relative sense, as many applications of mechanical specific energy use a trend in value and/or do not require an absolute value.

In certain methods according to the present invention where torque is not available in ft-lbs, Equation III (see above) is used. While units are shown above for Equation III, their use is not required for successful results with this method, as it still produces usable results with no units or even erroneous units (for example, conversion errors), as long as the values are proportional to the correct values. This is a robust solution for many typical rig conditions. The elimination of the constants from Equation II (480 and 1000) is similarly arbitrary. Methods using Equation III arbitrarily modify the $K_{adj}$ factor until the resulting mechanical specific energy "makes sense" (i.e. is in the ballpark) or is reasonable or is an expected value for a given drilling situation, and then keep that factor for future use of mechanical specific energy on that same rig with that same device for rotating the drillstring (i.e. the rotary table or the top drive). For such cases where torque in ft-lbs is not available: 1. mechanical specific energy values will be proportional to the magnitude of the torque term; 2. since the torque term is usually the dominant force, the values will be as applicable as the true values for all relative applications; 3. since the relative applications of mechanical specific energy are the most common (as opposed to absolute), Equation III methods provide values almost equal to mechanical specific energy for these applications; and 4. the chance of Equation III method's values providing misleading information to the user for relative applications of mechanical specific energy is very small; e.g. it is limited to those rare cases where the WOB term would be dominant over the torque term. For the cases where torque in ft-lbs is available, and Equation III methods are used, due to the robustness of Equation III calculations, situations where the data inputs may not be correctly calibrated or where the data inputs are in incorrect units can still produce usable results. If the resulting inputs are incorrect (per desired units) for any reason, but are proportional to the correct values, then the Equation III value will be superior to a (miscalculated) Equation II value; and 2. for cases where computations are at a premium (for example, in an embedded controller), Equation III calculations provide most of the value of mechanical specific energy for less computational effort. However, Equation III calculations do not have a meaningful absolute value (i.e. in Kpsi units) which can be globally compared with any other rig's or well's value (it can be compared over multiple wells drilled by the same rig); and the impact of the WOB term is neglected in the mechanical specific energy value. This is usually a small contribution. While Equation III will work with any (positive) value of $K_{adj}$, judicious selection of $K_{adj}$ will expand the general use value of these methods of determining mechanical specific energy.

The present invention, therefore in at least certain but not all preferred embodiments provides: a method for a wellbore operation with a wellbore system, the method including: acquiring with sensor systems data corresponding to a plurality of parameters, said data indicative of values for each parameter of said plurality of parameters, each parameter corresponding to part of the wellbore system; based on said data, calculating a mechanical specific energy value for each of a plurality of mechanical specific energies each related to a mechanical specific energy for a part of the wellbore system; and monitoring the value of each of the mechanical specific energies. Such a method may include one or some, in any possible combination, of the following: wherein the wellbore operation is any of drilling, milling, reaming, hole-opening, casing drilling, drilling with a downhole motor, coiled tubing operations, junk milling, milling-drilling, and managed pressure drilling; wherein the plurality of parameters includes any of WOB, ROP, bit rotational speed, torque at a bit, torque at surface, rotary rotational speed, and bit cross-sectional area; providing calculated mechanical specific energy values to alarm apparatus; providing an alarm with the alarm apparatus based on the values of the mechanical specific energies; providing calculated mechanical specific energy values to a control system for controlling the operation, and controlling the operation based on said calculated mechanical specific energy values; monitoring the values of calculated mechanical specific energy values and analyzing said values for indicating a problem with the wellbore operation; determining at least one solution j(or a plurality of possible solutions) to the problem based on the values of the calculated mechanical specific energy; providing confirmation that the at least one solution (or a solution chosen from a plurality of possible solutions) does not impede the wellbore operation; monitoring the values of calculated mechanical specific energy values and analyzing said values for indicating a problem with the wellbore operation, and based on said values determining which part of the wellbore system has the problem; wherein the wellbore operation is a drilling operation and drilling is accomplished with a drill system which is any of a rotary drive system, a top drive system, and a downhole motor system; analyzing said values of calculated mechanical specific energies to determine whether there is a change (e.g. an increase and/or decrease) in energy consumption by the wellbore operation; wherein the plurality of mechanical specific energies includes surface, drillstring, and bit mechanical specific energy; wherein surface mechanical specific energy is calculated using surface measured inputs and bit mechanical specific energy is calculated using downhole measured inputs actually measured downhole; wherein the values for mechanical specific energies are calculated using surface measured inputs; wherein drillstring mechanical specific energy is calculated using a difference between surface mechanical specific energy and bit mechanical specific energy; wherein the wellbore operation is an operation with a rotating bit (or reamer or mill) and values for the mechanical specific energies are calculated according to the equation for Teale's definition of mechanical specific energy; wherein the wellbore operation is an operation with a rotating bit and values for the mechanical specific energies are calculated according to Equation II; wherein the wellbore operation is an operation with a rotating bit (or reamer or mill) and values for the mechanical specific energies are calculated according to Equation III; providing in real time a display of calculated values of the plurality of mechanical specific energies; wherein a control system controls the wellbore operation, the method including controlling the wellbore operation with the control system; wherein the control system includes a computer readable medium having instructions for any of: providing an alarm if a pre-set value for a mechanical specific energy is exceeded; controlling system apparatuses used in the wellbore operation; conducting a diagnostic test of any of said system apparatuses; storing calculated values; and/or controlling the wellbore operation to execute a higher level strategy; wherein the wellbore operation is a hole-opening operation and mechanical specific energies are calculated using a volume of drilled-out material; wherein the mechanical specific energies are calculated with Equation IV; wherein the wellbore operation is a reaming operation for reaming an already-produced wellbore producing a reamed wellbore, and values for mechanical specific energies calculated for the already-produced wellbore are compared to values for mechanical specific energies calculated for the reaming operation; wherein the wellbore operation is a milling operation and values of calculated mechanical specific energies are monitored and processed to indicate any of: a change in mechanical specific energy as an item is first encountered by a mill; a change or trend in mechanical specific energy behavior as increasing amounts of material are milled; a drop in mechanical specific energy as a mill exits an item being milled; and/or a value of mechanical specific energy that indicates a mill is encountering formation outside an item being milled; and/or wherein the wellbore operation is managed pressure drilling and values of calculated mechanical specific energies are monitored and processed to indicate any of: a pressure differential in a wellbore; less energy required during drilling; and/or confirmation that drilling is progressing as desired.

The present invention, therefore, in at least certain but not all preferred embodiments provides a computer-readable media having computer executable instructions for a wellbore operation with a wellbore system, the computer-executable instructions performing the following steps: receiving from sensor systems data corresponding to a plurality of parameters, said data indicative of values for each parameter of said plurality of parameters, each parameter corresponding to part of the wellbore system, calculating, based on said data, a mechanical specific energy value for each of a plurality of mechanical specific energies each related to a mechanical specific energy for a part of the wellbore system, and transmitting to receiving apparatus signals indicative of the value of each of the calculated mechanical specific energies; and, in certain aspects, the computer-readable media wherein the receiving apparatus is a display system; and, in one aspect, a computing unit with such computer-readable media, the computing unit configured to read and perform the computer-executable instructions.

All patents referred to herein by number are incorporated fully herein for all purposes. In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A method for a wellbore operation with a wellbore system, the method comprising acquiring with sensor systems data corresponding to a plurality of parameters, said data indicative of values for each parameter of said plurality of parameters, each parameter corresponding to part of the wellbore system, based on said data, calculating a mechanical specific energy value for each of a plurality of mechanical specific energies each related to a mechanical specific energy for a part of the wellbore system, monitoring the value of each of the mechanical specific energies, wherein the wellbore operation is an operation with a rotating bit and values for the mechanical specific energies are calculated according to the equation for Teale's definition of mechanical specific energy, ES, where $$Es = \frac{WOB}{A} + \frac{120\pi(N)(T)}{A(ROP)}$$

and wherein WOB is weight on bit, N is rpm's of a rig's rotary, T is torque at the bit, ROP is rate of penetration, and A is wellbore or bit cross-sectional area.

2. The method of claim 1 wherein the wellbore operation is any of drilling, milling, reaming, hole-opening, casing drilling, drilling with a downhole motor, coiled tubing operations, junk milling, milling-drilling, and managed pressure drilling.

3. The method of claim 1 further comprising
providing calculated mechanical specific energy values to alarm apparatus.

4. The method of claim 3 further comprising
providing an alarm with the alarm apparatus based on the values of the mechanical specific energies.

5. The method of claim 1 further comprising
providing calculated mechanical specific energy values to a control system for controlling the operation, and
controlling the operation based on said calculated mechanical specific energy values.

6. The method of claim 1 further comprising
monitoring the values of calculated mechanical specific energy values and analyzing said values for indicating a problem with the wellbore operation.

7. The method of claim 6 further comprising
determining at least one solution to the problem based on the values of the calculated mechanical specific energy.

8. The method of claim 7 further comprising
providing confirmation that the at least one solution does not impede the wellbore operation.

9. The method of claim 1 further comprising
monitoring the values of calculated mechanical specific energy values and analyzing said values for indicating a problem with the wellbore operation, and
based on said values determining which part of the wellbore system has the problem.

10. The method of claim 1 wherein the wellbore operation is a drilling operation and drilling is accomplished with a drill system which is any of a rotary drive system, a top drive system, and a downhole motor system.

11. The method of claim 1 further comprising
analyzing said values of calculated mechanical specific energies to determine whether there is a change in energy consumption by the wellbore operation.

12. The method of claim 1 wherein the plurality of mechanical specific energies includes surface, drillstring, and bit mechanical specific energy.

13. The method of claim 12 wherein surface mechanical specific energy is calculated using surface measured inputs and bit mechanical specific energy is calculated using downhole measured inputs actually measured downhole.

14. The method of claim 12 wherein the values for mechanical specific energies are calculated using surface measured inputs.

15. The method of claim 12 wherein drillstring mechanical specific energy is calculated using a difference between surface mechanical specific energy and bit mechanical specific energy.

16. The method of claim 1 further comprising
providing in real time a display of calculated values of the plurality of mechanical specific energies.

17. The method of claim 1 wherein a control system controls the wellbore operation, the method further comprising
controlling the wellbore operation with the control system.

18. The method of claim 17 wherein the control system includes a computer readable medium having instructions for any of: providing an alarm if a pre-set value for a mechanical specific energy is exceeded; controlling system apparatuses used in the wellbore operation; conducting a diagnostic test of any of said system apparatuses; storing calculated values; and controlling the wellbore operation to execute a higher level strategy.

19. The method of claim 1 wherein the wellbore operation is a hole-opening operation and mechanical specific energies are calculated using a volume of drilled-out material.

20. The method of claim 1 wherein the wellbore operation is a reaming operation for reaming an already-produced wellbore producing a reamed wellbore, and values for mechanical specific energies calculated for the already-produced wellbore are compared to values for mechanical specific energies calculated for the reaming operation.

21. The method of claim 1 wherein the wellbore operation is a milling operation and values of calculated mechanical specific energies are monitored and processed to indicate any of: a change in mechanical specific energy as an item is first encountered by a mill; a change or trend in mechanical specific energy behavior as increasing amounts of material are milled; a drop in mechanical specific energy as a mill exits an item being milled; and a value of mechanical specific energy that indicates a mill is encountering formation outside an item being milled.

22. The method of claim 1 wherein the wellbore operation is managed pressure drilling and values of calculated mechanical specific energies are monitored and processed to indicate any of: a pressure differential in a wellbore; less energy required during drilling; and confirmation that drilling is progressing as desired.

23. A computer-readable media having computer executable instructions for a wellbore operation with a wellbore system, the computer-executable instructions performing the following steps:
receiving from sensor systems data corresponding to a plurality of parameters, said data indicative of values for each parameter of said plurality of parameters, each parameter corresponding to part of the wellbore system,
calculating, based on said data, a mechanical specific energy value for each of a plurality of mechanical specific energies each related to a mechanical specific energy for a part of the wellbore system,
wherein the wellbore operation is an operation with a rotating bit and values for the mechanical specific energies are calculated according to the equation for Teale's definition of mechanical specific energy, ES, where $$Es = \frac{WOB}{A} + \frac{120\pi(N)(T)}{A(ROP)}$$

and wherein WOB is weight on bit, N is rpm's of a rig's rotary, T is torque at the bit, ROP is rate of penetration, and A is wellbore or bit cross-sectional area, and
transmitting to receiving apparatus signals indicative of the value of each of the calculated mechanical specific energies.

24. The computer-readable media of claim 23 wherein the receiving apparatus is a display system.

25. A computing unit configured to read and perform the computer-executable instructions on computer-readable media as recited in claim 23.

26. A method for a wellbore operation with a wellbore system, the method comprising
acquiring with sensor systems data corresponding to a plurality of parameters, said data indicative of values for each parameter of said plurality of parameters, each parameter corresponding to part of the wellbore system, based on said data, calculating a mechanical specific energy value for each of a plurality of mechanical specific energies each related to a mechanical specific energy for a part of the wellbore system, monitoring the value of each of the mechanical specific energies, wherein the wellbore operation is an operation with a rotating bit and values for the mechanical specific energies are calculated according to the equation $$MSE = Eff_b \times \left( \frac{4 \times WOB}{\pi \times D^2 \times 1000} \times \frac{480 \times N_b \times T}{D^2 \times ROP \times 1000} \right)$$

wherein

MSE=Mechanical Specific Energy, in Kpsi

Effb=Bit efficiency

WOB=Weight on bit, in lbs

D=Bit diameter, in inches

Nb=Bit rotational speed, in rpm

T=Drillstring rotational torque, in ft-lb

ROP=Rate-of-penetration, in ft/hr.

27. A method for a wellbore operation with a wellbore system, the method comprising acquiring with sensor systems data corresponding to a plurality of parameters, said data indicative of values for each parameter of said plurality of parameters, each parameter corresponding to part of the wellbore system, based on said data, calculating a mechanical specific energy value for each of a plurality of mechanical specific energies each related to a mechanical specific energy for a part of the wellbore system, monitoring the value of each of the mechanical specific energies, wherein the wellbore operation is an operation with a rotating bit and values for the mechanical specific energies are calculated according to the equation $$MSE = K_{adj} \times Eff_b \times \left( \frac{N_b \times T_{rel}}{D^2 \times ROP} \right)$$

wherein

MSE=Mechanical Specific Energy

Kadj=Adjustment factor

Effb=Bit efficiency

D=Bit diameter, in inches

Nb=Bit rotational speed, in rpm

Trel=Relative measure of drillstring rotational torque, units as per device

ROP=Rate-of-penetration, in ft/hr.

28. A method for a wellbore operation with a wellbore system, the method comprising acquiring with sensor systems data corresponding to a plurality of parameters, said data indicative of values for each parameter of said plurality of parameters, each parameter corresponding to part of the wellbore system, based on said data, calculating a mechanical specific energy value for each of a plurality of mechanical specific energies each related to a mechanical specific energy for a part of the wellbore system, monitoring the value of each of the mechanical specific energies, wherein the mechanical specific energies are calculated with the equation $$Es = \frac{WOB}{A_{104} - A_{102}} + \frac{120\pi(N)(T)}{(A_{104} - A_{102})(ROP)}$$

wherein A104 is an area of a new hole 104 and A102 is an area of an original hole 102.

* * * * *